US011370102B2

(12) United States Patent
Schadow et al.

(10) Patent No.: US 11,370,102 B2
(45) Date of Patent: Jun. 28, 2022

(54) METHOD FOR CAPTURING AT LEAST ONE CHARACTERISTIC VALUE OF AT LEAST ONE TOOL

(71) Applicant: Robert Bosch GmbH, Stuttgart (DE)

(72) Inventors: Joachim Schadow, Stuttgart (DE); Joern Stock, Leinfelden-Echterdingen (DE); Florian Esenwein, Leinfelden-Echterdingen (DE); Anna Heszler, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 137 days.

(21) Appl. No.: 16/498,270

(22) PCT Filed: Feb. 28, 2018

(86) PCT No.: PCT/EP2018/054872
§ 371 (c)(1),
(2) Date: Oct. 31, 2019

(87) PCT Pub. No.: WO2018/177669
PCT Pub. Date: Oct. 4, 2018

(65) Prior Publication Data

US 2020/0094394 A1 Mar. 26, 2020

(30) Foreign Application Priority Data

Mar. 29, 2017 (DE) ..... 10 2017 205 308.9

(51) Int. Cl.
*B25F 5/02* (2006.01)
*B25D 17/00* (2006.01)

(52) U.S. Cl.
CPC ..... *B25F 5/02* (2013.01); *B25D 17/00* (2013.01); *B25D 2250/005* (2013.01); *B25D 2250/221* (2013.01)

(58) Field of Classification Search
CPC ..... B25F 5/02
See application file for complete search history.

(56) References Cited

U.S. PATENT DOCUMENTS 5,313,712 A * 5/1994 Curameng ..... G01C 17/20 33/354
D449,009 S * 10/2001 Gardiner ..... D10/62
(Continued)

FOREIGN PATENT DOCUMENTS

DE 10 2012 208 870 A1 11/2013
DE 10 2014 226 051 A1 6/2016
(Continued)

OTHER PUBLICATIONS

International Search Report corresponding to PCT Application No. PCT/EP2018/054872, dated Jun. 4, 2018 (German and English language document) (5 pages).

*Primary Examiner* — Nathaniel C Chukwurah
*Assistant Examiner* — Lucas E. A. Palmer
(74) *Attorney, Agent, or Firm* — Maginot, Moore & Beck LLP

(57) ABSTRACT

A method for sensing at least one characteristic value of at least one tool, in particular a hand-held power tool, includes detachably connecting the tool to at least one additional module and detecting with the additional module at least one characteristic value of the tool. The method further includes carrying out at least one training operation. The training operation includes deriving at least one reference value from the at least one characteristic value via the additional module and storing the reference value.

11 Claims, 3 Drawing Sheets

(56) References Cited

U.S. PATENT DOCUMENTS 6,598,684 B2 * 7/2003 Watanabe ..... B25B 21/02 173/176
6,926,473 B2 * 8/2005 Luebke ..... B25F 5/00 408/16
8,274,273 B2 * 9/2012 Nguyen ..... G01R 1/0408 324/126
9,004,191 B2 * 4/2015 Muller ..... B25F 5/006 173/162.2
9,756,402 B2 * 9/2017 Stampfl ..... B23Q 17/00
9,802,299 B2 * 10/2017 Hung ..... B25B 23/147
2003/0218469 A1 * 11/2003 Brazell ..... G01V 3/15 324/637
2004/0016058 A1 * 1/2004 Gardiner ..... G01C 17/00 7/119
2004/0182587 A1 * 9/2004 May ..... B25B 23/1405 173/2
2005/0000998 A1 * 1/2005 Grazioli ..... B25D 17/24 227/2
2005/0069391 A1 * 3/2005 Dils ..... G01V 3/15 408/16
2005/0247460 A1 * 11/2005 Luebke ..... G01V 3/15 173/2
2005/0280393 A1 * 12/2005 Feldmann ..... B25F 5/00 320/114
2008/0196910 A1 * 8/2008 Radle ..... G01V 3/15 173/2
2014/0151079 A1 * 6/2014 Furui ..... B25F 3/00 173/46
2014/0240125 A1 * 8/2014 Burch ..... G06Q 10/06 340/539.13
2014/0259599 A1 * 9/2014 Glaspell ..... B25F 5/021 29/407.04
2015/0136433 A1 * 5/2015 Nitsche ..... B25D 11/005 173/2
2015/0209950 A1 * 7/2015 Lutz ..... B25F 5/02 173/20
2015/0209951 A1 * 7/2015 Lutz ..... B23Q 17/00 173/20
2016/0067859 A1 * 3/2016 Rejman ..... B25F 5/02 439/577
2016/0129540 A1 * 5/2016 Tiede ..... B23Q 11/0046 173/197
2016/0311094 A1 * 10/2016 Mergener ..... B25B 23/1475
2016/0342151 A1 * 11/2016 Dey, IV ..... G05B 19/4155
2017/0083014 A1 * 3/2017 Conrad ..... G05B 19/425
2017/0173768 A1 * 6/2017 Dey, IV ..... B25B 23/1475

FOREIGN PATENT DOCUMENTS

EP 2 628 427 A2 8/2013
JP 2004-70424 A 3/2004
JP 2011-121139 A 6/2011
JP 2012-139752 A 7/2012
JP 2014-525840 A 10/2014
JP 2017-209743 A 11/2017
WO 2017/025247 A1 2/2017

* cited by examiner

METHOD FOR CAPTURING AT LEAST ONE CHARACTERISTIC VALUE OF AT LEAST ONE TOOL

This application is a 35 U.S.C. § 371 National Stage Application of PCT/EP2018/054872, filed on Feb. 28, 2018, which claims the benefit of priority to Serial No. DE 10 2017 205 308.9, filed on Mar. 29, 2017 in Germany, the disclosures of which are incorporated herein by reference in their entirety.

BACKGROUND

A method has previously been proposed for capturing at least one characteristic variable of at least one tool, specifically of a hand-held power tool, which is connected to at least one additional module, specifically in a detachable manner, wherein the additional module detects at least one characteristic variable of the tool in at least one process step.

SUMMARY

The disclosure proceeds from a method for capturing at least one characteristic variable of at least one tool, specifically of a hand-held power tool, which is connected to at least one additional module, specifically in a detachable manner, wherein the additional module detects at least one characteristic variable of the tool in at least one process step.

It is proposed that, in at least one process step, at least one training operation is executed, in which at least one reference value for the at least one characteristic variable is derived by means of the at least one additional module, and is saved. Accordingly, the additional module can advantageously be assigned to accompany a hand-held power tool throughout its service life, thereby specifically permitting advantageous data capture and comparison processes. Variances and/or tolerances associated with manufacture can be advantageously considered in a relative comparison. In the present context, "detection" is specifically to be understood as a detection and/or reception operation. The characteristic variable can specifically be a motor temperature, hours of duty, the tools employed, a position and/or location of the hand-held power tool, an acceleration and/or a vibration of the hand-held power tool, a current consumption, a voltage, a torque, or any such further values as shall be considered relevant by a person skilled in the art.

The additional module preferably comprises a data processing unit, which incorporates at least one electronic unit. The electronic unit comprises at least one transistor and, particularly preferably at least one microprocessor. Particularly preferably, the additional module, specifically the electronic unit, incorporates at least one computing unit. A "computing unit" is specifically to be understood as a unit having a data input, a data processing function and a data output. Advantageously, the computing unit comprises at least one processor, a memory, input and output means, further electronic components, an operating program, regulation routines, control routines and/or calculation routines. Preferably, components of the computing unit are arranged on a common circuit board, specifically of the electronic unit, and/or are advantageously arranged in a common housing. Preferably, the additional module comprises at least one sensor unit for the detection of a user-specific and/or a hand-held power tool-specific characteristic variable. In the present context, the term "sensor unit" is specifically to be understood as a unit which is designed for the recording of at least one characteristic variable and/or one physical property, wherein said recording can be executed actively, specifically by the generation and transmission of an electrical measuring signal, and/or passively, specifically by the detection of variations in the properties of a sensor component.

Preferably, the additional module, specifically the electronic unit, comprises at least one communication unit, specifically an NFC communication unit, for the purposes of wire-based and/or wireless data transmission, specifically with a hand-held power tool. Preferably, the communication unit is configured as a transmitter and/or receiver unit for the transmission of electronic data. The additional module preferably comprises at least two transmitter and/or receiver units or information units, specifically at least one NFC transmitter and/or receiver unit, and a Bluetooth transmitter and/or receiver unit. Alternatively or additionally, the additional module comprises at least one or more information unit(s) such as, for example, a QR code, a data matrix code or similar. Preferably, at least one of the at least two transmitter and/or receiver units, specifically an NFC transmitter and/or receiver unit, is configured for a rapid connection set-up between the additional module and an external unit, specifically the hand-held power tool. Preferably, at least one of the at least two transmitter and/or receiver units, specifically a Bluetooth transmitter and/or receiver unit, is configured for data transmission, specifically for the transmission of a plurality of data within a short time interval, between the additional module and an external unit, specifically of the hand-held power tool. Preferably, an antenna of the communication unit is arranged on the additional module, such that a main radiation direction of the antenna can be oriented in the direction of the cover unit.

In this context, the tool can specifically be a machine tool, specifically a hand-held power tool, an item of workwear and/or a technical accessory such as, for example, a wristband and/or a wristwatch. The term "hand-held tool" is specifically to be understood as a workpiece-processing tool, advantageously however as a drilling machine, a hammer and/or percussion drill, a saw, a plane, a screwdriver, a milling cutter, an angle grinder, a corner grinder, a cutting tool, a tile cutter, a gardening tool and/or a multi-purpose tool. Preferably, the hand-held power tool is transportable by a user without the use of transport machinery. Preferably, the hand-held power tool specifically has a mass of less than 40 kg, preferably less than 10 kg, and particularly preferably less than 5 kg. Preferably, the additional module is mechanically and/or electrically connectable to the hand-held power tool and, specifically, the additional module can be arranged on the hand-held power tool by means of a, preferably detachable, retaining mechanism. The retaining mechanism can be configured, for example, as an adhesive mechanism, a riveting mechanism, a Velcro fastener mechanism, a cable-tie mechanism, a latching mechanism, a bayonet connector mechanism, or similar. In this context, however, it is also conceivable that not only hand-held power tools, but also stationary machines, specifically such as concrete mixers or combustion engine-driven machines, can be monitored. It is further conceivable that the communication unit is provided for data exchange with an external device such as, for example, a smartphone, a tablet, a PC and/or similar, specifically for the control of the additional module, for the execution of a firmware upgrade, for a read-out from the additional module, or for any such further function as may be considered appropriate by a person skilled in the art. Preferably, the training operation is executed in conjunction with initial entry into service. Specifically, the training operation terminates upon the expiry of a specific time period, or upon the completion of specific training steps. The term "provided" is specifically to be understood as specially programmed, designed and/or configured. Herein, it is specifically understood, in that an object is provided for a specific function, that said object executes said specific function in at least one application and/or operating state.

It is further proposed that, in at least one process step, at least one calibration operation is executed, wherein at least one operating value for the characteristic variable is derived and saved by means of the at least one additional module. It is thus possible for advantageous conclusions to be identified with respect to wear, damage, servicing requirements and/or the misuse of specific components of the tool. In the calibration operation, advantageously, the at least one operating value is derived from the at least one characteristic variable under predefined conditions. The predefined condition can specifically be an off-load and/or on-load situation, specifically in different positions of the device.

It is further proposed that, in at least one process step, from a comparison of the at least one operating value with the at least one reference value, a wear characteristic of the at least one tool is established. A degree of wear, and specifically any wear, damage or servicing requirements can advantageously be detected as a result. Preferably, the wear characteristic of the at least one tool is established by means of the additional module and/or an external application. In this context, the external application can specifically be constituted by an external computing unit, specifically a computer, a server, a smartphone and/or a tablet.

It is further proposed that, in at least one process step, from a comparison of the at least one operating value with the at least one reference value, a malfunction characteristic of the at least one tool is established. As a result, a risk of injury and/or damage to the tool can advantageously be prevented, or at least reduced. The malfunction characteristic can specifically incorporate information on misuse and/or an overload characteristic. Specifically, the malfunction characteristic of the at least one tool is established by means of an additional module, or in an external application.

It is further proposed that, in at least one process step, at least one statistical operation is executed, wherein at least one statistical characteristic is derived from the at least one characteristic variable by means of the at least one additional module, and is saved. Thus, advantageously, any change in the tool over time can be detected and, for example, servicing requirements can be generated in a dynamic manner. The statistical characteristics are advantageously saved in a database of the additional module and/or in an external application. Preferably, the statistical characteristics include a running time, and a number of actuations and/or applications of the tool.

It is further proposed that, in at least one process step, at least one application-specific instruction associated with the at least one characteristic variable is generated by means of the at least one additional module. Advantageously, a care instruction, service information, a quote for maintenance and/or for a customer service can thus be generated for the attention of and/or quoted to a user. Preferably, the application-specific instruction is generated in accordance with the wear characteristic, the malfunction characteristic and/or the statistical characteristic.

It is further proposed that, in at least one process step, at least one positional characteristic of the tool is detected by means of the at least one additional module. Thus, for the purposes of data collection, a relationship to an orientation of the tool in a space can advantageously be established. As a result, moreover, more accurate determinations of the wear characteristic, the malfunction characteristic and/or the statistical characteristic can be achieved.

It is further proposed that, in at least one process step, at least one environmental characteristic of the tool is detected by means of the at least one additional module. As a result, external influences such as, specifically, an ambient temperature and/or atmospheric humidity can advantageously be incorporated in the evaluation of a characteristic variable of the tool such as, specifically, a service temperature.

Particularly advantageously, the method according to the disclosure is executed by an additional module, specifically for a tool and/or for a hand-held power tool. A tool, specifically a hand-held power tool, having at least one additional module according to the disclosure, is further proposed.

The method according to the disclosure is not limited to the above-mentioned application and execution. Specifically, the method according to the disclosure for the achievement of a mode of operation described herein can comprise a different number of individual process steps to the number specified herein.

BRIEF DESCRIPTION OF THE DRAWINGS

Further advantages proceed from the following description of the drawings. The drawings represent an exemplary embodiment of the disclosure. The drawings, the description and the claims incorporate numerous process steps, in combination. A person skilled in the art will also appropriately consider the process steps in an individual manner, and will infer further appropriate combinations.

In the drawing.

DETAILED DESCRIPTION

Figure 1:
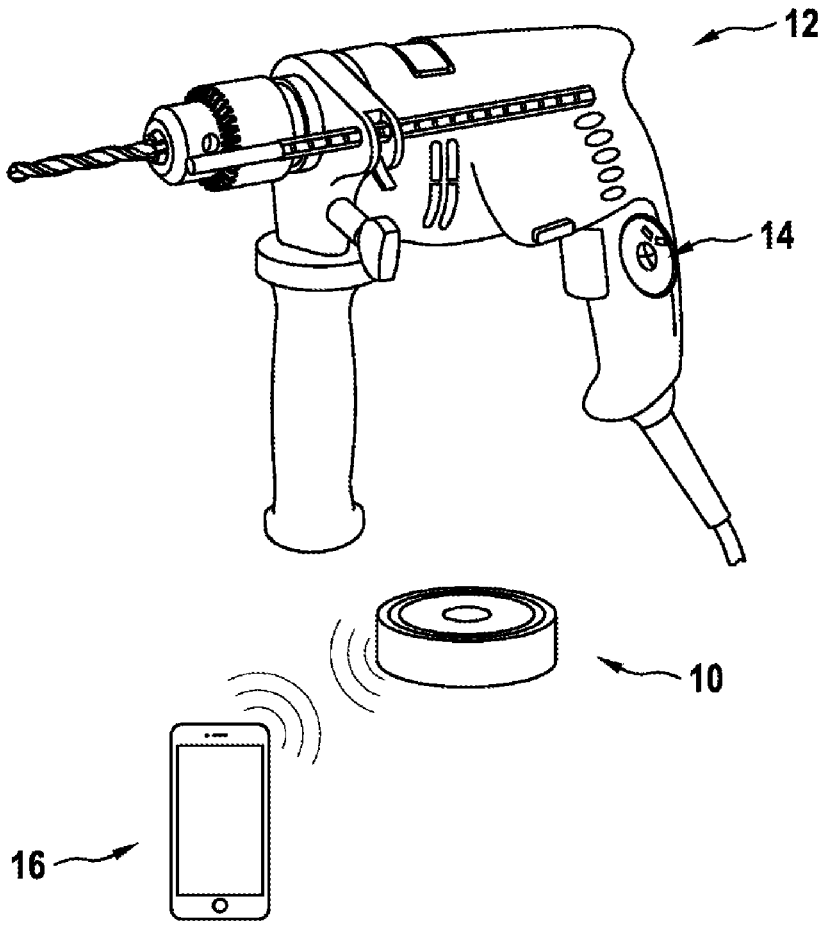
FIG. 1 shows a tool configured as a hand-held power tool and an additional module, in a perspective representation.

FIG. 1 shows an additional module 10 and a tool 12. The tool 12 constitutes a hand-held power tool. The tool 12 constitutes a hammer drill. The tool 12 comprises a base unit 14 which is configured as a locator region for the additional module 10. The tool 12 comprises a contact means, which is not represented in greater detail, and is arranged on the locator region for the electrical contacting of a contact unit of the additional module 10. Between the tool 12 and the additional module 10, by means of the contact means and the contact unit, data and/or electrical energy for the operation of the additional module 10 are transmittable. The additional module 10 can be detachably secured in the base unit 14 which is configured as a locator region for the additional module 10. The additional module 10 is provided for the detection, processing and saving of a characteristic variable of the tool 12. The additional module 10 is further provided for wireless communication with an external device 16. The external device 16 is constituted, for example, as represented here, by a smartphone. The additional module 10 is provided for the transmission of the characteristic variable of the tool 12 to the external device 16.

Figure 2:
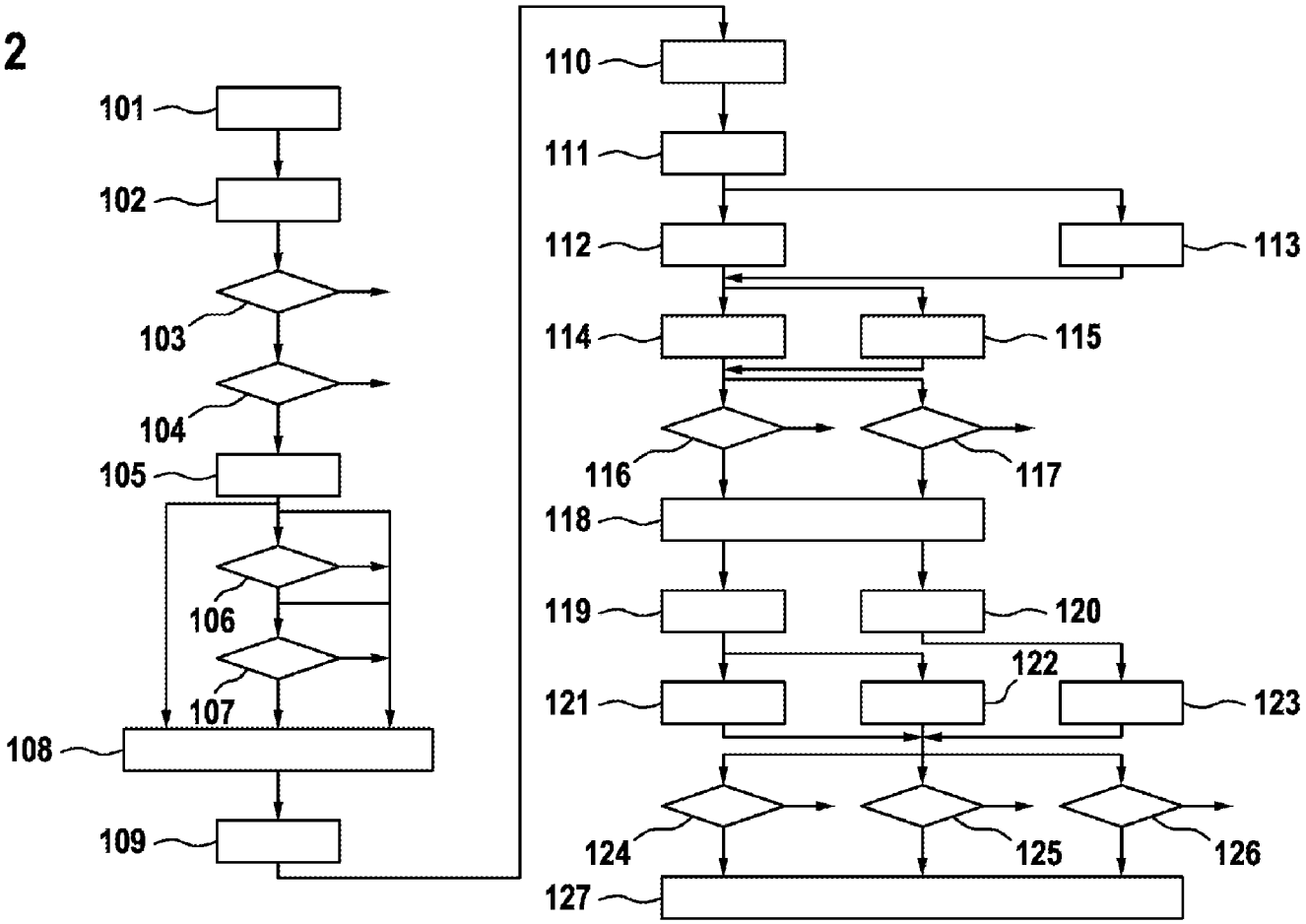
FIG. 2 shows a flow diagram of a method for detecting at least one characteristic variable of the tool.

FIG. 2 shows a flow diagram of a method for detecting at least one characteristic variable of the tool 12. In a first process step 101, the additional module 10 is connected to the tool 12, and specifically is detachably connected. In a first process step 101, the additional module 10 is further logged onto the tool 12. This can also be achieved, for example, by means of an application which is executed on the external device 16. In a second process step 102, the additional module 10 detects at least one characteristic variable of the tool 12. For exemplary purposes only, and by way of illustration, a motor temperature of a motor of the tool 12 is assumed hereinafter as the characteristic variable. The characteristic variable might also describe vibration values, or an off-load speed. The first process step 101 is advantageously started directly, specifically automatically, immediately after the additional module 10 has been coupled to the tool 12.

In the second process step 102, a training operation is started. In the training operation, at least one reference value for the at least one characteristic variable is derived and saved by means of the additional module 10. For example, in the training operation, a motor temperature is detected after an operating time of one minute, and is saved as a reference value.

In a third process step 103 it is decided whether the training operation has been successfully initiated. If not, for example, the first or second process step 101, 102 can be repeated. If the training operation has been successful, it is decided, in a fourth process step 104, whether all the requisite reference values have been detected. If this is not the case, for example, the first or second process step 101, 102 can be repeated.

If all the requisite characteristic variables have been detected in the fourth process step 104, a continuous saving of reference values is executed within the additional module 10 in a fifth process step 105. Optionally, in a sixth process step 106, reference values can be exported to an external storage unit, specifically to the device 16. Further optionally, in a seventh process step 107, reference values can be exported to an external processing unit, specifically to the device 16.

In an eighth process step 108, from the characteristic variables and/or reference values detected, a fingerprint is generated and/or saved. It is conceivable for the reference values to be further checked for plausibility against manufacturer's specifications which, for example, incorporate tolerances, and are filed in the form of measuring ranges, bandwidths and/or limiting values. The fingerprint incorporates device-specific reference values and/or data for precisely one tool 12. The additional module 10 is assigned to accompany the tool 12 throughout its service life. Additionally and/or alternatively, raw data are saved. In a ninth process step 109, the training operation is terminated.

In a tenth process step 110, a calibration operation is started. In the calibration operation, at least one operating value for the characteristic variable is derived by means of the additional module 10, and is saved in an eleventh process step 111.

In a twelfth process step 112, the operating value is transmitted to an on-board data processing unit of the additional module 10. Additionally or alternatively, in a thirteenth process step 113, the operating value is transmitted to an external data processing unit, for example a data processing unit of the external device 16.

In a fourteenth process step 114, the reference value determined by means of the training operation is transferred to the corresponding data processing unit. Additionally or alternatively, registered limiting values, specifically from a manufacturer and/or a corporate database, are retrieved in a fifteenth process step 115, and are transmitted to the corresponding data processing unit.

In a sixteenth process step 116, it is determined whether a limiting value has been breached. This can specifically be achieved by means of the additional module 10 or by means of the external device 16. Additionally or alternatively, in a seventeenth process step 117, it is determined whether an anomaly and/or a change has occurred. This can specifically be achieved by means of the additional module 10 or by means of the external device 16. If neither a limiting value is breached, nor an anomaly and/or a change is detected, it is conceivable to execute a return to the tenth process step 110.

If a limiting value is breached or an anomaly and/or a change is detected, in an eighteenth process step 118, this information is referred to an evaluation and/or communication unit. The requisite characteristic variables, operating values, limiting values and/or reference values for this purpose are referred to the data processing unit of the additional module 10 in a nineteenth process step 119. At the same time, the requisite characteristic variables, operating values, limiting values and/or reference values are referred to an external data processing device, for example of the device 16, in a twentieth process step 120.

Proceeding from the nineteenth process step 119, in a twenty-first process step 121, a malfunction characteristic for the tool 12 is determined by a comparison of the operating value with the reference value. Determination of the malfunction characteristic is executed by means of an algorithm and/or by a comparison of the operating value with reference models and/or limiting values which have been registered internally, specifically in the training operation. By means of the additional module 10, a positional characteristic of the tool 12 is detected, specifically for an improvement of the determination of the malfunction characteristic. For example, it can thus be considered how long the tool 12 has been operated in an overhead operation. By means of the additional module 10, an environmental characteristic of the tool 12 is detected, specifically for an improvement of the determination of the malfunction characteristic. It is thus possible to establish an excessively high motor temperature, for example with further reference to a potentially high ambient temperature.

Proceeding from the nineteenth process step 119, alternatively and/or additionally to the twenty-first process step 121, a malfunction characteristic of the tool 12 is established by a comparison of the operating value with the reference value, in a twenty-second process step 122. Determination of the malfunction characteristic is executed by means of an algorithm and/or by a comparison of the operating value with externally registered reference models and/or limiting values, specifically retrieved from a database. For example, a current motor temperature is compared with a maximum motor temperature.

Proceeding from the twentieth process step 120, in a twenty-third process step 123, a malfunction characteristic of the tool 12 is determined by a comparison of the operating value with the reference value, by means of an external data processing unit. Determination of the malfunction characteristic is executed by means of an algorithm and/or by a comparison of the operating value with internally and/or externally registered reference models and/or limiting values.

From the results of the twenty-first process step 121, the twenty-second process step 122 and/or the twenty-third process step 123, it is determined, in a twenty-fourth process step 124, whether a malfunction characteristic which is relevant to a user is present. If no relevant malfunction characteristic is identified, it is conceivable to execute a return to the tenth process step 110. This can occur, for example, where the current motor temperature lies below a maximum motor temperature. If a malfunction characteristic which is relevant to a user is present, the twenty-seventh process step 127 is then executed. This might be the case, for example, if the current motor temperature exceeds a maximum motor temperature.

From the results of the twenty-first process step 121, the twenty-second process step 122 and/or the twenty-third process step 123, it is determined, in a twenty-fifth process step 125, whether a maintenance operation is required. If no maintenance operation is required, it is conceivable to execute a return to the tenth process step 110. This can occur, for example, where the current motor temperature lies below a maximum motor temperature. If a maintenance operation is required, the twenty-seventh process step 127 is then executed. This might be the case, for example, if the current motor temperature significantly exceeds a maximum motor temperature.

From the results of the twenty-first process step 121, the twenty-second process step 122 and/or the twenty-third process step 123, it is determined, in a twenty-sixth process step 126, whether a device parameter requires adjustment. If no device parameter requires adjustment, it is conceivable to execute a return to the tenth process step 110. This can occur, for example, where the current motor temperature lies below a maximum motor temperature. If an adjustment of a device parameter is required, the twenty-seventh process step 127 is then executed. This might be the case, for example, if the current motor temperature exceeds a maximum motor temperature. An adjustment of a device parameter might entail, for example, a limitation of a maximum current consumption.

In the twenty-seventh process step 127, an application-specific instruction is generated by means of the additional module 10, in accordance with the characteristic variable. Alternatively and/or additionally, an application-specific instruction can be generated by means of the external device 16, in accordance with the characteristic variable. The application-specific instruction can comprise a care instruction, service information and/or a quote for maintenance, and/or can constitute an offer of customer service. The application-specific instruction is generated in accordance with the malfunction characteristic. To this end, the additional module 10 and/or the external device 16 comprises an output unit, specifically a display, at least one light-emitting diode and/or a loudspeaker.

Figure 3:
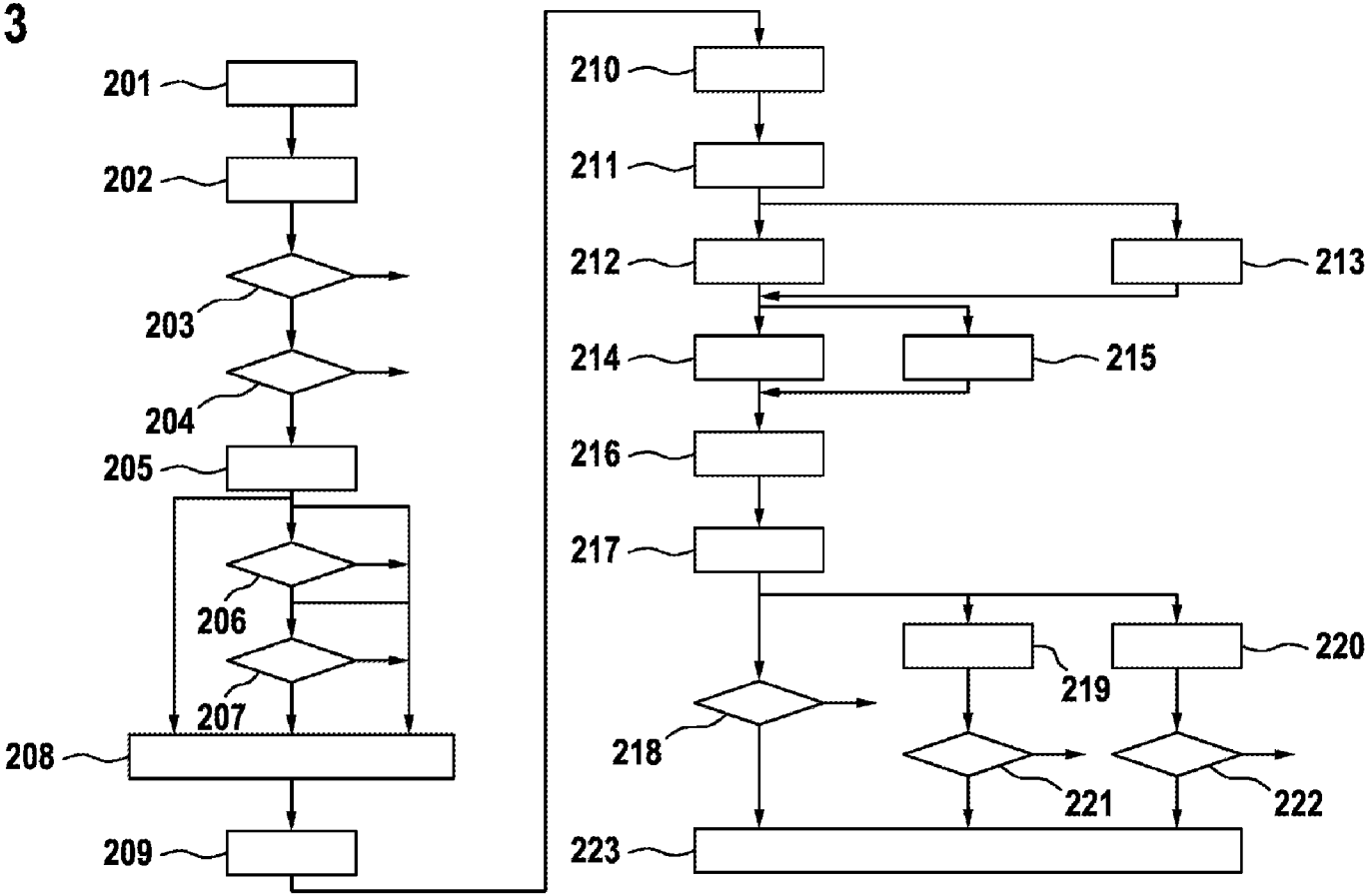
FIG. 3 shows a flow diagram of an alternative method for detecting at least one characteristic variable of the tool.

FIG. 3 shows an alternative method for the detection of at least one characteristic variable of the tool 12, represented in a flow diagram. In a first process step 201, the additional module 10 is connected to the tool 12, and specifically is detachably connected. In a first process step 201, the additional module 10 is further logged onto the tool 12. This can also be achieved, for example, by means of an application which is executed on the external device 16. In a second process step 202, the additional module 10 detects at least one characteristic variable of the tool 12. For exemplary purposes only, and by way of illustration, a motor temperature of a motor of the tool 12 is assumed hereinafter as the characteristic variable. The first process step 201 is advantageously started directly, specifically automatically, immediately after the additional module 10 has been coupled to the tool 12.

In the second process step 202, a training operation is started. In the training operation, at least one reference value for the at least one characteristic variable is derived and saved by means of the additional module 10. For example, in the training operation, a motor temperature is detected after an operating time of one minute, and is saved as a reference value.

In a third process step 203 it is decided whether the training operation has been successfully initiated. If not, for example, the first or second process step 201, 202 can be repeated. If the training operation has been successful, it is decided, in a fourth process step 204, whether all the requisite reference values have been detected. If this is not the case, for example, the first or second process step 201, 202 can be repeated.

If all the requisite characteristic variables have been detected in the fourth process step 204, a continuous saving of reference values is executed within the additional module 10 in a fifth process step 205. Optionally, in a sixth process step 206, reference values can be exported to an external storage unit, specifically to the device 16. Further optionally, in a seventh process step 207, reference values can be exported to an external processing unit, specifically to the device 16.

In an eighth process step 208, from the characteristic variables and/or reference values detected, a fingerprint is generated and/or saved. The fingerprint incorporates device-specific reference values and/or data for precisely one tool 12. The additional module 10 is assigned to accompany the tool 12 throughout its service life. Additionally and/or alternatively, raw data are saved. In a ninth process step 209, the training operation is terminated.

In a tenth process step 210, a calibration operation is started. In the calibration operation, at least one operating value for the characteristic variable is derived by means of the additional module 10, and is saved in an eleventh process step 211.

In a twelfth process step 212, the operating value is transmitted to an on-board data processing unit of the additional module 10. Additionally or alternatively, in a thirteenth process step 213, the operating value is transmitted to an external data processing unit, for example a data processing unit of the external device 16.

In a fourteenth process step 214, the reference value determined by means of the training operation is transferred to the corresponding data processing unit. Additionally or alternatively, registered limiting values, specifically from a manufacturer and/or a corporate database, are retrieved in a fifteenth process step 215, and are transmitted to the corresponding data processing unit.

In a sixteenth process step 216, the operating value is evaluated. From a comparison of the operating value with the reference value, a wear characteristic of the tool 12 is established. For example, in the event of the long-term occurrence of an excessively high motor temperature, wear to a permanent magnet of an electric motor might be concluded. The wear characteristic of the tool 12 is established by means of the additional module 10 and/or in an external application, specifically in an external device 16. In a seventeenth process step 217, the wear characteristic is referred to a storage unit and/or to a database. Specifically, the wear characteristic is saved in the additional module 10 and/or in the external device 16.

From the saved results of the seventeenth process step 217, it is determined, in an eighteenth process step 218, whether a wear characteristic which is relevant to a user is present. If no relevant wear characteristic is identified, it is conceivable to execute a return to the tenth process step 210. This can occur, for example, where the current motor temperature lies below a maximum motor temperature. If a wear characteristic which is relevant to a user is present, the twenty-third process step 223 is then executed. This might be the case, for example, if the current motor temperature exceeds a maximum motor temperature in a long-term and/or continuous manner.

From the saved results of the seventeenth process step 217, a statistical operation is executed in a nineteenth process step 219. A statistical characteristic is derived from the at least one characteristic variable by means of the additional module 10, and is saved. In this context, however, it is also conceivable that the statistical characteristic is derived from the at least one characteristic variable and is saved by means of the external device 16. For example, an operating time counter can be increased in accordance with an increased motor temperature and/or speed.

From the results of the nineteenth process step 219, in a twenty-first process step 221, it is determined whether a limiting value for the operating time counter has been achieved. If the limiting value has not been achieved, it is conceivable to execute a return to the tenth process step 210. If a limiting value has been achieved, the twenty-third process step 223 is then executed.

Additionally and/or alternatively, from the saved results of the seventeenth process step 217, a statistical operation is executed in a twentieth process step 220. A statistical characteristic is derived from the at least one characteristic variable by means of the additional module 10, and is saved. In this context, however, it is also conceivable that the statistical characteristic is derived from the at least one characteristic variable and is saved by means of the external device 16. For example, an application counter can be increased in accordance with a number of increased motor temperatures.

From the results of the twentieth process step 220, in a twenty-second process step 222, it is determined whether a limiting value for the application counter has been achieved. If the limiting value has not been achieved, it is conceivable to execute a return to the tenth process step 210. If a limiting value has been achieved, the twenty-third process step 223 is then executed.

In the twenty-third process step 223, an application-specific instruction is generated by means of the additional module 10, in accordance with the characteristic variable. Alternatively and/or additionally, an application-specific instruction can be generated by means of the external device 16, in accordance with the characteristic variable. The application-specific instruction can comprise a care instruction, service information and/or a quote for maintenance, and/or can constitute an offer of customer service. The application-specific instruction is generated in accordance with the wear characteristic and/or the statistical characteristic. To this end, the additional module 10 and/or the external device 16 comprises an output unit, specifically a display, at least one light-emitting diode and/or a loudspeaker.

The invention claimed is:

1. A method for capturing at least one characteristic variable of at least one tool, comprising:

connecting the tool to at least one additional module that is separate from the at least one tool;

detecting with a sensor of the additional module at least one characteristic variable of the tool;

executing at least one training operation in which at least one reference value for the at least one characteristic variable is derived via the additional module, and is saved;

executing at least one calibration operation, wherein at least one operating value for the characteristic variable is derived and saved via the additional module; and establishing a malfunction characteristic of the tool from a comparison of the at least one operating value with the at least one reference value using the additional module.

2. The method as claimed in claim 1, further comprising establishing a wear characteristic of the tool from a comparison of the at least one operating value with the at least one reference value.

3. The method as claimed in claim 1, further comprising executing at least one statistical operation, wherein at least one statistical characteristic is derived from the at least one characteristic variable via the additional module, and is saved.

4. The method as claimed in claim 1, further comprising generating at least one application-specific instruction associated with the at least one characteristic variable via the additional module.

5. The method as claimed in claim 1, further comprising detecting at least one positional characteristic of the tool via the additional module.

6. The method as claimed in claim 1, further comprising detecting at least one environmental characteristic of the tool via the additional module.

7. The method as claimed in claim 1, wherein the tool is configured as a hand-held power tool.

8. The method as claimed in claim 1, wherein the tool is detachably connected to the additional module.

9. An additional module for the execution of a method for capturing at least one characteristic variable of at least one tool, the additional module being separate from the tool and configured to:

connect to the tool;

detect at least one characteristic variable of the tool;

execute at least one training operation in which at least one reference value for the at least one characteristic variable is derived via the additional module and saved;

execute at least one calibration operation, wherein at least one operating value for the characteristic variable is derived and saved via the additional module; and establish a malfunction characteristic of the tool from a comparison of the at least one operating value with the at least one reference value.

10. A tool, comprising:

at least one additional module that is separate from the at least one tool and configured to execute a method for capturing at least one characteristic variable of the tool, the additional module further configured to:

connect to the tool;

detect at least one characteristic variable of the tool using a sensor of the additional module;

execute at least one training operation in which at least one reference value for the at least one characteristic variable is derived via the additional module and saved;

execute at least one calibration operation, wherein at least one operating value for the characteristic variable is derived and saved via the additional module; and establish a malfunction characteristic of the tool from a comparison of the at least one operating value with the at least one reference value.

11. The tool as claimed in claim 10, wherein the tool is configured as a hand-held power tool.

* * * * *